US007086457B2

(12) United States Patent
Kienböck et al.

(10) Patent No.: US 7,086,457 B2
(45) Date of Patent: Aug. 8, 2006

(54) HEAT EXCHANGER FOR INDUSTRIAL INSTALLATIONS

(75) Inventors: Martin Kienböck, Ratingen (DE); Miroslav Podhorsky, Ratingen (DE)

(73) Assignee: Balcke-Durr GmbH, Ratingen (DE)

( * ) Notice: Subject to any disclaimer, the term of this patent is extended or adjusted under 35 U.S.C. 154(b) by 0 days.

(21) Appl. No.: 11/030,325

(22) Filed: Jan. 7, 2005

(65) Prior Publication Data

US 2005/0178534 A1 Aug. 18, 2005

(30) Foreign Application Priority Data

Jan. 8, 2004 (EP) ..... 04000280

(51) Int. Cl.
*F28D 1/03* (2006.01)

(52) U.S. Cl. ..... 165/148; 165/166; 165/181

(58) Field of Classification Search ..... 165/148, 165/133, 164, 166, 181; 62/324.1
See application file for complete search history.

(56) References Cited

U.S. PATENT DOCUMENTS

| | | | | |
|---|---|---|---|---|
| 4,253,520 | A * | 3/1981 | Friedericy et al. | 165/166 |
| 6,142,222 | A | 11/2000 | Kang et al. | 165/148 |
| 6,284,206 | B1 * | 9/2001 | Lesieur et al. | 165/138 |
| 6,604,573 | B1 * | 8/2003 | Morishima et al. | 165/153 |

FOREIGN PATENT DOCUMENTS

| | | |
|---|---|---|
| FR | 2738625 | 9/1995 |
| WO | 02/42707 | 5/2002 |

OTHER PUBLICATIONS

D. Girlich, K. Hackeschmidt, C. Kühn and R. Riedl, "Mechanical Properties of Open Pore Aluminum Foams", Konstruktion, Sep. 9, 2004, pp. 69-74.

Dr. Dieter Girlich, Prof. Dr. -Ing. Uwe Franzke, "Open Pore Metal Foams For Heat Exchange In Ventilation And Refrigeration", Advanced Engineering Materials 2001, 3, No. 6, pp. 351-352.

"Possible Uses of Offenporigen Metal Foams", GUSS-Produkte 2000, p. 253.

* cited by examiner

*Primary Examiner*—Teresa J. Walberg
(74) *Attorney, Agent, or Firm*—Baker & Hostetler LLP

(57) ABSTRACT

The invention concerns a heat exchanger for industrial installations, in particular for power plants, with at least one distributor for a fluid medium and at least one heat exchanger element attached to the distributor. The heat exchanger is composed of a sandwich-like configuration of distributors and heat exchanger elements consisting of metal sponges. The distributors are constructed as pipes or at least as semi-pipes connected with each other. Adjacent pipes or semi-pipes are connected with each other through the metal sponge. The sandwich profile of the invention may easily be manufactured in the required dimensions for industrial installations. Herein, particularly the low weight of such a heat exchanger module and the connection between shell and metal sponge, which may simply be made by means of soldering or welding, proves to be particularly advantageous. The metal foam may also be cast onto the shells. The metal sponge should preferably consist of open-pored metal foam and in particular aluminum foam.

19 Claims, 3 Drawing Sheets

HEAT EXCHANGER FOR INDUSTRIAL INSTALLATIONS

CROSS REFERENCE TO RELATED APPLICATIONS

This application claims priority to European Patent Application No. 04000280.0, filed Jan. 8, 2004, titled HEAT EXCHANGER FOR INDUSTRIAL INSTALLATIONS, the disclosure of which is incorporated herein by reference in its entirety.

FIELD OF THE INVENTION

The invention concerns a heat exchanger for industrial installations, in particular for power plants, with at least one distributor for a fluid medium and at least one heat exchanger attached to a distributor.

BACKGROUND OF THE INVENTION

The heat exchangers known from the power plant area generally consist of a distributor pipe, the exterior surface of which is at least partly covered with a cooling web. Such heat exchangers are used for example as air ventilated condensers. It is also known that heat exchangers are used as a cooling device in industrial installations of the chemical and food industry.

Generally, heat exchangers may dissipate or supply energy. Generally, an energy exchange takes place in the form of a heat transfer from a fluid medium with a higher temperature in a distributor pipe to a fluid medium with a lower temperature. During this process, the warmer medium is cooled while the colder medium is heated at the same time. In a power plant, the energy exchange process occurs in a way that the medium flowing through the cooling medium directs its heat into the cooling web around the steel pipe. The steel pipe is usually coated with a metal which has a good thermal conductivity, such as aluminum. The cooling web is usually also made of aluminum and is circulated by cooling air, cooling gas or similar, so that the heat may be dissipated to the surrounding area.

In addition, in the area semi-conductor building elements and electronic modules it is known to apply miniature metal sponge blocks to micro building elements, in order to cool these. In this context, it is referred to the publication documents DE 10207671 A1 and DE 10123456 A1.

In the area of power plants, it has shown as a disadvantage that heat exchangers consisting of a distributor pipe and a cooling web are only designable up to a certain length, because the mounting is otherwise hindered by the high weight. In addition, the cooling web requires a large space in order to reach a sufficient enlargement of the surface and provide sufficiently ventilated interspaces to dissipate heat. This effect is intensified even more in a configuration of several distributor pipes next to each other.

SUMMARY OF THE INVENTION

The invention shall thus serve to create a heat exchanger for industrial installations, in particular power plants, allowing smaller diameters and lower weight by means of good thermal conductivity. In addition, the invention shall thus, in consideration of a simple manufacture and mounting, facilitate heat exchangers of large dimensions for power plants.

For a heat exchanger of the kind initially described, the task is handled in a way that it is composed of a sandwich-like configuration of distributors and metal sponges, whereas the distributor consists of pipes or semi-pipes connected with each other, and that adjacent pipes or semi-pipes are connected with each other via metal sponges.

The stacked sandwich profile of the invention may easily be manufactured with a foreseeable effort and in particular in the required dimensions for industrial installations. Herein, particularly the low weight of such a heat exchanger module proves to be beneficial, which only weighs a portion of homogenous metal. Also, the connection between the pipe and the semi-pipe and the metal sponge may easily be created by soldering or welding. In addition, the metal foam may easily be cast on. Favorable characteristics of the metal foam are the high energy absorption capacity, the good thermal conductivity, good flow, the mechanic stability at a low weight and a large inner surface.

The term "semi-pipe", which is used here, describes tub- or duct-like half shells made of steel plate. For example rounded rectangular sections or semi-elliptical sections may be used for this purpose. The tubes may show rectangular or curved, in particular, circular or elliptical steel hollow sections.

A preferred construction is also that the semi-pipe is replenished to a full pipe. In a stacked configuration, a heat exchanger may be designed where a metal sponge is placed between the two adjacent and separated pipes or semi-pipes.

A further preferred construction is that the semi-pipe is designed as a steel plate half shell. In a reversed image configuration of two such sandwich sections of half shell and metal sponge, such a heat exchanger may be designed with a pipe shaped distributor running between two metal sponges. For the creation of half shell metal foam sections, the metal foam may be cast on the already formed steel plate shell.

In a further appropriate construction, a trapezoid section is foreseen for the half shell. This simplifies the stacking and connection of several heat exchanger modules over each other.

In a further preferred construction, the section of the half shell shows a predetermined curve progression. In particular, a section shaped as an ellipsis or a drop is suitable. By casting the metal foam onto the shell, this may easily be adjusted to the curve progression of the shell.

To form a particularly suitable sandwich-like heat exchanger module, a half shell is fixed on the opposite sides of the metal sponge. Here, it is recommended to align half shells on the two longer sides of a cuboid metal foam block symmetrically to the midplane of the metal foam block. Since the metal foam may easily be formed into a block like body, it is appropriate to attach half shells or even flattened steel pipes on it. When using open shells, it is recommended to let the edges of the shell project over the metal sponge, so that the shell edges of a further similar heat exchanger module may be soldered or welded on. In this way, the firmness of the entire heat exchanger is increased.

Regarding the above mentioned heat exchanger modules, a stacked configuration is particularly recommended. Based on the good thermal conductivity of metal foams, heat exchanger elements and thus heat exchangers of smaller dimensions are possible, whereby the space may better be used.

Advantageously, the edges of the half shells of adjacent heat exchanger modules are welded together on their front walls. In this way, any number of heat exchanger modules may be composed in a stacked configuration according to the incurring amount of fluid and according to the requirements of the energy exchange that must be provided.

In this regard, it is recommended that the edges be designed as a connecting flange projecting over the metal sponge. The length and direction of the connecting flange may be designed according to the connection type. Advantageously, the connecting flanges of adjacent heat exchanger modules are welded together with resistance roller welding machines. Such a welding process enables a continuous manufacturing process, whereas the foaming of the molten bath and the casting-on of the metal sponge may also be included in this continuous operation.

A further advantage in the construction of the connecting flanges is that the edges of the opposite connecting flange of adjacent heat exchanger modules are connected with a covering to form another distributor. This distributor serves to absorb the fluid leaking from the metal sponge or to feed a fluid into the metal sponge. Thereby, the metal foam may easily be cooled. Furthermore, the dripping water resulting from the evaporation may also be conducted through the other distributor.

In another preferred construction, at least one shell is soldered to at least one metal sponge. For this purpose, on the shell section which is to be connected with the metal foam, hard solder (e.g. as a plating) may be applied, which has a lower melting point than the material of the shell (e.g. steel) and the metal sponge (e.g. aluminum). After stacking and bracing of two such shells, for example, with a metal sponge lying in-between, the package held in this way is sent through a soldering channel and heated to a melting point temperature of the solder, so that by means of the melting solder a metallurgic compound between the shells and the metal sponge is formed.

An improved interchange output is achieved because at least one metal sponge consists of open-pored metal foam. The latter shows good thermal conductivity and allows good flow. Advantageously, the metal sponge consists of aluminum foam. Its weight is only approx. 1/10 of the weight of homogenous aluminum. Aluminum foam may also easily be bound with the shells by soldering, welding or casting. Alternatively, also closed pored meal foam may be applied.

Another advantage consists in the fact that a fluid medium may flow through the metal sponge. In this way, a fluid medium, such as water, may also flow through the metal sponge.

Metal foam is manufactured by means of a known procedure by foaming the molten bath or by means of a powder metallurgical procedure.

BRIEF DESCRIPTION OF THE DRAWINGS

In the following, the invention is further explained by means of preferred constructions by referring to figures. It shows a scheme of the following.

DETAILED DESCRIPTION

In the following figures, three constructions of heat exchanger modules for the formation of a heat exchanger of the invention are represented. Herein, the same components are marked with the same reference signs.

Figure 1:
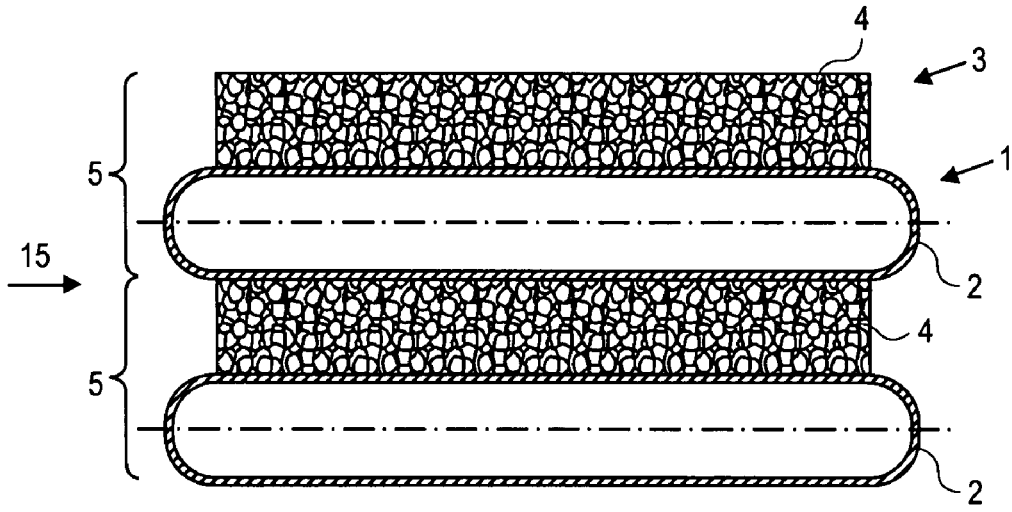
FIG. 1 cross-section of a stacked configuration of two sandwich-like heat exchanger modules in their first construction.

FIG. 1 shows a cross-section of two stacked sandwich-like heat exchanger modules 5 in a first construction, which are composed of a distributor 1 and a heat exchanger element 3. The distributor 1 is formed by a full pipe 2 with a leveled steel hollow section, which is coated with aluminum. This thin-walled steel hollow section is only a few millimeters thick. As a heat exchanger element 3, a metal sponge 4 of open-pored aluminum foam is foreseen. The metal sponge 4 and full pipes 2 are stacked alternatively over each other and are soldered and welded together. Alternatively, the components of the heat exchanger module 5 may also be agglutinated.

As may be seen from FIG. 1, the rounded sides of full pipes 2 protrude over the metal sponges 4. Thereby, a sufficient space to connect the neighboring heat exchanger modules 5 and the metal sponge 4 may show a simple geometric form. However, the metal sponges 4 located on the upper and lower semi-pipe 2 may also run circular and completely around the semi-pipes 2. It is also possible to attach appropriately formed parts made of metal sponge subsequently.

The heat exchanger modules 5 according to FIG. 1, which were particularly developed for use in power plants, have a length (vertically to plotting plane) of 10 m to 12 m. With regard to their height, according to the quantitative performance and transformable energy, the required number of similar heat exchange modules 5 is stacked on top of each other. The upper and lower ending of the heat exchanger is usually made by a metal sponge 4, so that each semi-tube 2 is placed between two metal sponges 4.

To cool the water or steam pumped in the full pipes 2 during the operation, air flows through the metal sponges 4 in the direction of arrow 15, so that the heat transferred through the steel sheet of shell 2 to the corresponding metal sponge 4 may be directed to the side and outward (see FIG. 1, right) due to the air flow.

If water is sprayed into the air stream, the water is thus transported into the metal sponge 4, and the cooling effect is increased.

Figure 2:
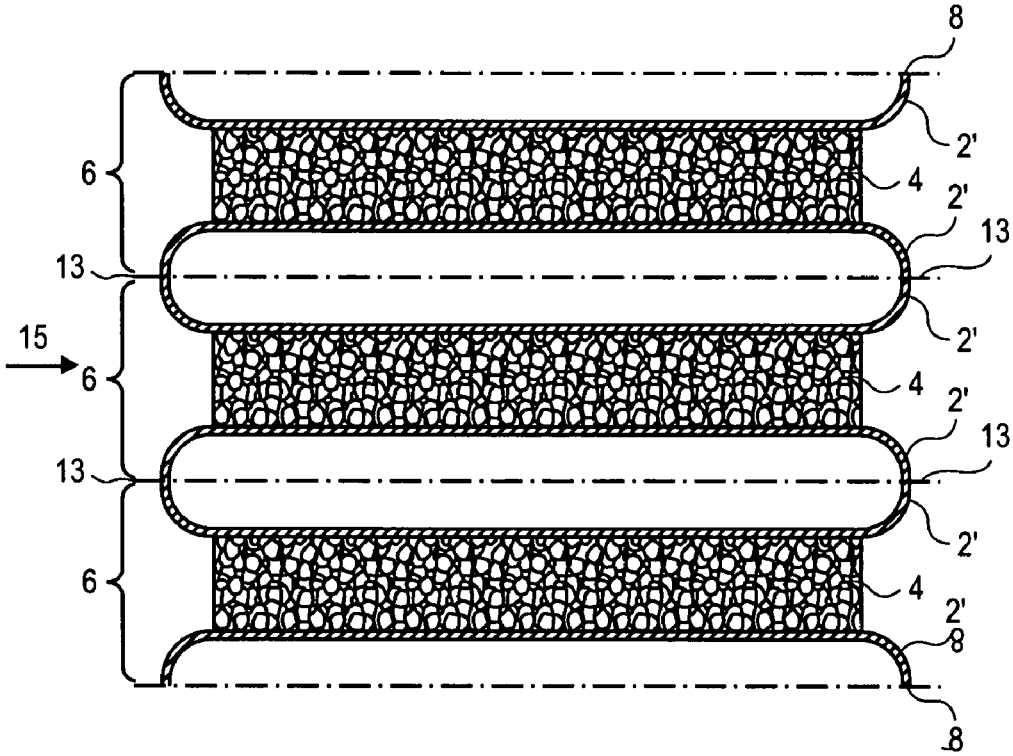
FIG. 2 a cross-section of a stacked configuration of three sandwich-like heat exchanger modules of a second construction.

FIG. 2 shows a cross-section of a stacked configuration of three sandwich-like heat exchanger modules 6 of a second design, which each consist of a metal sponge 4 and two semi-shells 2' made of steel plate, located on the opposite long sides of the metal sponge 4. Unlike the construction shown in FIG. 1, the metal foam is cast onto the two semi-shells 2'. The two semi-shells 2' project, as in FIG. 1, laterally over the metal sponge 4. Herein, the opposite lateral edges 8 of the upper and lower semi-shell 2' are directed away from each other. This enables a better anchorage of the heat exchanger modules 6. To form a stack, the three heat exchanger modules 6 are soldered on the opposite lateral edges 8 of the semi-shells 2' over a seam butt 13 running across the entire length (vertically to the plotting plane). Otherwise, the metal sponges 4 and the semi-shells 2' are made of the same materials as in FIG. 1 and show approximately the same geometric dimensions. The heat exchanger module 6 may alternatively also only show one shell 2'. In this design, concavely shaped semi-shells would also be possible.

Figure 3:
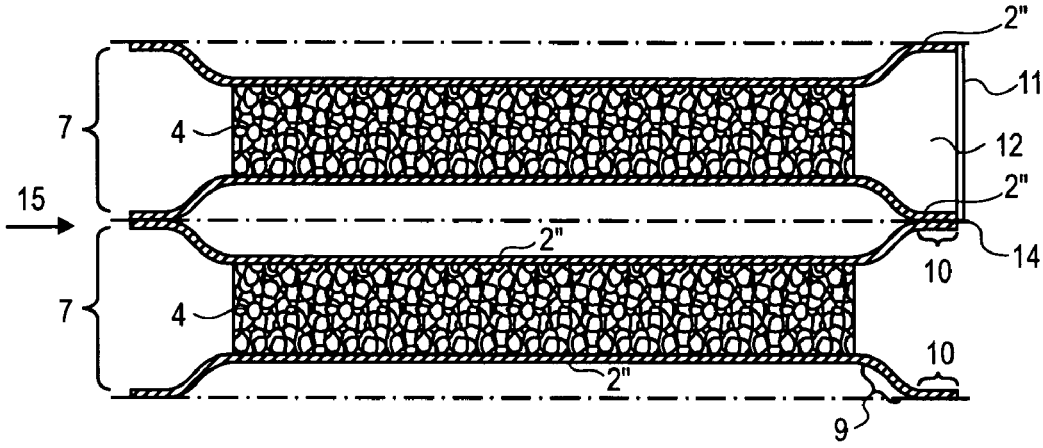
FIG. 3 a cross-section of a stacked configuration of two sandwich-like heat exchanger modules of a third construction.

FIG. 3 shows the cross-section of two sandwich-like heat exchanger modules 7 of a third construction in a stacked configuration. Herein, the semi-shells 2" are trapezoid. The metal sponge 4 is connected with an upper and a lower semi-shell 2" to form a heat exchange module 7. Just like in FIG. 2, this connection is made by casting the metal foam onto the semi-shells 2". The edges of the semi-shells 2" form an angled connecting flange 9. The two heat exchanger modules 7 are stacked and welded with resistance roller welding machines in a way that the straight line ends 10 of the connecting flange 9 lie flush with each other. In the resistance roller welding machine, the stack of heat exchanger modules 7 configured over each other run through a welding channel, in which the adjacent ends 10 of the connecting flange 9 are run over rollers and welded together on their surfaces.

Furthermore, FIG. 3 shows a covering 11 for example on the right edge of the upper heat exchanger module 6, which connects the opposite ends 10 of the connecting flange 9 of the two semi-shells 2" of the upper heat exchanger module 7. This end allows the formation of a further distributor 12, which runs longitudinally (vertically to the plotting plane). The covering is on one hand intended for the case that a coolant flows through the metal sponge 4 (arrow 15) and is led away through the other distributor. Analogously, on the left margin of the upper heat exchanger module 6, a covering 11 for the formation of a distributor 12, which supplies coolant, is also possible. Accordingly, all margins of the heat exchanger module 7 shown in FIG. 3 may be provided with coverings 11.

Alternatively, on one of the flanges or on both, a channel (not shown) may be created to lead off so-called dripping water. It occurs when air flows through the metal sponge 4 (arrow 15) due to the air cooling in metal sponge 4.

The heat exchanger modules indicated in FIGS. 2 and 3 are completed for the construction of a complete heat exchanger by each an upper and lower ending module, consisting of a semi-shell 2' or 2" and a metal sponge 4.

The metal sponges 4 shown in FIGS. 1 to 3 may also be constructed in different heights. The stacking of several heat exchanger modules, 5, 6, 7 may be carried out in a way that the metal sponges 4 of different heat exchanger modules 5, 6, 7 lie over each other. The height resulting from the adjacent position of two metal sponges 4 may thus be determined by the height of the individual metal sponges 4.

In order to avoid a tear on the connections between the metal sponges 4 and the shells 2, 2' and 2" in very long heat exchanger modules (e.g. 10 to 12 m), an equalizing layer may at least partly be introduced between metal sponge 4 and shells, 2, 2' 2". Thereby, the tensions resulting from the different heat expansion coefficients of steel and aluminum and the high pressure within shells 2, 2' 2" may be reduced or compensated.

The invention claimed is:

1. Heat exchanger for industrial installations, in particular for power plants, with at least one distributor for a fluid medium and at least one heat exchanger element attached to the distributor, comprising:

a sandwich-like configuration of distributors and heat exchanger elements comprising of metal sponges, whereas the distributor comprises of at least one of a pipe and semi-pipes connected with each other, and wherein the pipe or semi-pipes are connected with each other via metal sponges, wherein the pipe or semi-pipes have edges constructed as a flange that projects a distance over and beyond the metal sponges and wherein the pipe or semi-pipes are trapezoid in cross-sectional shape.

2. Heat exchanger according to claim 1, wherein the pipe is constructed as a full pipe.

3. Heat exchanger according to claim 2, wherein the full pipe is composed of two semi-pipes.

4. Heat exchanger according to claim 3, wherein the semi-pipe is constructed as a metal semi-shell.

5. Heat exchanger according to claim 1 wherein the shell shows a predetermined curve progression in its cross-section.

6. Heat exchanger according to claim 1 wherein the opposite sides of the metal sponge, the pipe or the semi-shell pipes are attached to form a sandwich-like heat exchanger module.

7. Heat exchanger according to claim 1 wherein the heat exchanger modules are stacked over each other.

8. Heat exchanger according to claim 4 wherein the edges of the semi-shells pipes of the two heat exchanger modules are welded together on the front.

9. Heat exchanger according to claim 8, wherein the flange of the adjacent heat exchanger modules are welded together with resistance roller welding machines.

10. Heat exchanger according to claim 9, wherein the edges of the opposite connecting flanges of the adjacent heat exchanger modules are connected with a covering to form a further distributor, which serves to absorb fluid leaking from the metal sponge or to supply the metal sponge with a fluid.

11. Heat exchanger according to claim 1 wherein the pipe or the semi-shellpipes are welded with at least one metal sponge.

12. Heat exchanger according to claim, 1 wherein the at least one metal sponge comprises of open-pored metal foam.

13. Heat exchanger according to claim 1 wherein the at least one metal sponge-comprises of aluminum foam.

14. Heat exchanger according to claim 1 wherein the at least one metal sponge allows a fluid medium to flow through.

15. Heat exchanger according to claim 14, wherein air, in which water is sprayed in, flows through the at least one metal sponge.

16. Heat exchanger for industrial installations, in particular for power plants, with at least one distributor for a fluid medium and at least one heat exchanger element attached to the distributor, comprising:

a sandwich-like configuration of distributors and heat exchanger elements comprising of metal sponges, whereas the distributor comprises of at least one of a pipe and semi-pipes connected with each other, and wherein the pipe or semi-pipes are connected with each other via metal sponges, wherein the pipe or semi-pipes each comprise first and second opposing side walls that are generally parallel to one another, and third and fourth walls that extend between the first and second walls at an angle to one another.

17. Heat exchanger according to claim 16, wherein the pipe or semi-pipes extend a distance over and beyond the metal sponges.

18. Heat exchanger for industrial installations, in particular for power plants, with at least one distributor for a fluid medium and at least one heat exchanger element attached to the distributor, comprising:

a sandwich-like configuration of distributors and heat exchanger elements comprising of metal sponges, whereas the distributor comprises of at least one of a pipe and semi-pipes connected with each other, and wherein the pipe or semi-pipes are connected with each other via metal sponges, wherein the pipe or semi-pipes wherein the pipe or semi-pipes each extend a distance over and beyond the metal sponges.

19. Heat exchanger according to claim 18, further comprising first and second opposing side walls that are generally parallel to one another, and third and fourth walls that extend between the first and second walls at an angle to one another.

* * * * *

UNITED STATES PATENT AND TRADEMARK OFFICE

CERTIFICATE OF CORRECTION

PATENT NO. : 7,086,457 B2
APPLICATION NO. : 11/030325
DATED : August 8, 2006
INVENTOR(S) : Martin Kienbock and Miroslav Podhorsky It is certified that error appears in the above-identified patent and that said Letters Patent is hereby corrected as shown below:

The applicant hereby request that the claims as amended on February 14, 2006, be updated and added to the issued patent referenced above. The claims as amended are:
Column 5, line 40 - Column 6, line 64 amend claims 1-19 as follows:

Claim 1 should read - A heat exchanger for industrial installations, in particular for power plants, with at least one distributor for a fluid medium and at least one heat exchanger element attached to the distributor comprising:
a sandwich-like configuration of distributors and heat exchanger elements comprising of metal sponges, whereas the distributor comprises of at least one of a pipe and semi-pipes connected with each other, and wherein the pipe or semi-pipes are connected with each other via metal sponges, wherein the pipe or semi-pipes have edges constructed as a flange that projects a distance over and beyond the metal sponges and wherein the pipe or semi-pipes are trapezoid in cross-sectional shape.

Claim 2 should read - A heat exchanger according to claim 1, wherein the pipe is constructed as a full pipe.

Claim 3 should read - A heat exchanger according to claim 2, wherein the full pipe is composed of two semi-pipes.

Claim 4 should read - A heat exchanger according to claim 3, wherein the semi-pipe is constructed as a metal semi-shell.

Claim 5 should read - A heat exchanger according to claim 1 wherein the shelf shows a predetermined curve progression in its cross-section.

Claim 6 should read - A heat exchanger according to claim 1 wherein the opposite sides of the metal sponge, the pipe or the semi-shell pipes are attached to form a sandwich-like heat exchanger module.

Claim 7 should read - A heat exchanger according to claim 1 wherein the heat exchanger modules are stacked over each other.

Signed and Sealed this

Twelfth Day of October, 2010

David J. Kappos

David J. Kappos
*Director of the United States Patent and Trademark Office*

Claim 8 should read - A heat exchanger according to claim 4 wherein the edges of the semi-shells pipes of the two heat exchanger modules are welded together on the front.

Claim 9 should read - A heat exchanger according to claim 8, wherein the flange of the adjacent heat exchanger modules are welded together with resistance roller welding machines.

Claim 10 should read - A heat exchanger according to claim 9, wherein the edges of the opposite connecting flanges of the adjacent heat exchanger modules are connected with a covering to form a further distributor, which serves to absorb fluid leaking from the metal sponge or to supply the metal sponge with a fluid.

Claim 11 should read - A heat exchanger according to claim 1, wherein the pipe or the semi-shell pipes are welded with at least one metal sponge.

Claim 12 should read - A heat exchanger according to claim 1, wherein the at least one metal sponge comprises of open-pored metal foam.

Claim 13 should read - A heat exchanger according to claim 1, wherein the at least one metal sponge-comprises of aluminum foam.

Claim 14 should read - A heat exchanger according to claim 1, wherein the at least one metal sponge allows a fluid medium to flow through.

Claim 15 should read - A heat exchanger according to claim 14, wherein air, in which water is sprayed in, flows through the at least one metal sponge.

Claim 16 should read - A heat exchanger for industrial installations, in particular for power plants, with at least one distributor for a fluid medium and at least one heat exchanger element attached to the distributor, comprising:
a sandwich-like configuration of distributors and heat exchanger elements comprising of metal sponges, whereas the distributor comprises of at least one of a pipe and semi-pipes connected with each other, and wherein the pipe or semi-pipes are connected with each other via metal sponges, wherein the pipe or semi-pipes each comprise first and second opposing side walls that are generally parallel to one another, and third and fourth walls that extend between the first and second walls at an angle to one another.

Claim 17 should read - A heat exchanger according to claim 16, wherein the pipe or semi-pipes extend a distance over and beyond the metal sponges.

Claim 18 should read - A heat exchanger for industrial installations, in particular for power plants, with at least one distributor for a fluid medium and at least one heat exchanger element attached to the distributor, comprising:
a sandwich-like configuration of distributors and heat exchanger elements comprising of metal sponges, whereas the distributor comprises of at least one of a pipe and semi-pipes connected with each other, and wherein the pipe or semi-pipes are connected with each other via metal sponges, wherein the pipe or semi-pipes each extend a distance over and beyond the metal sponges.

Claim 19 should read - A heat exchanger according to claim 18, further comprising first and second opposing side walls that are generally parallel to one another, and third and fourth walls that extend between the first and second walls at an angle to one another.